US006270080B1

(12) United States Patent
Chang

(10) Patent No.: US 6,270,080 B1
(45) Date of Patent: Aug. 7, 2001

(54) COIN-OPERATED ITEM VENDING AND GAME APPARATUS

(76) Inventor: Kil Jae Chang, T.PiCO. Korea Manufacturing, 321-37 Suksu 2 Dong, Anyang City, Kyungkido (KR)

( * ) Notice: Subject to any disclaimer, the term of this patent is extended or adjusted under 35 U.S.C. 154(b) by 0 days.

(21) Appl. No.: 09/405,290

(22) Filed: Sep. 23, 1999

(51) Int. Cl.[7] ..... A63F 7/00

(52) U.S. Cl. ..... 273/399; 273/317.3; 273/400; 273/402; 273/405; 273/398; 273/138.3; 273/440

(58) Field of Search ..... 273/317.3, 399, 273/400, 401, 402, 405, 398, 138.3, 138.4, 129 R, 440, 355

(56) References Cited

U.S. PATENT DOCUMENTS

| | | | | |
|---|---|---|---|---|
| 553,078 | | 1/1896 | Smith et al. . | |
| 1,138,261 | | 5/1915 | Troidl . | |
| 1,572,090 | * | 2/1926 | Smith | 463/48 |
| 1,594,066 | * | 7/1926 | Mills | 273/138.3 |
| 1,700,154 | * | 1/1929 | Calvert | 273/138.3 |
| 2,606,088 | | 8/1952 | Leaf . | |
| 2,675,238 | | 4/1954 | Leaf . | |
| 2,959,415 | | 11/1960 | Peterson . | |
| 4,243,227 | | 1/1981 | Strongin . | |
| 4,297,807 | | 11/1981 | Buettner . | |
| 4,487,414 | | 12/1984 | Kärkkäinen et al. . | |
| 5,104,124 | * | 4/1992 | Bernard et al. | 273/317.3 |
| 5,417,435 | | 5/1995 | Peretz . | |
| 5,697,828 | | 12/1997 | Smathers et al. . | |

* cited by examiner

*Primary Examiner*—Benjamin H. Layno
(74) *Attorney, Agent, or Firm*—Flanagan & Flanagan; John R. Flanagan; John K. Flanagan

(57) ABSTRACT

A coin-operated item vending and game apparatus includes a coin-operated item vending machine and a game module. The vending machine includes a support base, coin deposit, vendable items dispenser, globe and elongated central support member. The game module includes a housing, target and flexible resilient lever. The housing is disposed within the globe. The target is disposed within the housing. The lever is disposed below the target and extends through the housing and globe such that an outer end of the lever is disposed exteriorly of the globe. A depression defined on the lever receives a coin. The outer end of the lever is manually depressed downwardly by the user causing bending of the lever from an initial condition and creating an upward force because of the resiliency of the lever. Release of the lever by the user allows the lever to spring back to its initial condition and toss the coin upwardly such that the coin will either make or miss the target depending on the skill of the user.

20 Claims, 3 Drawing Sheets

COIN-OPERATED ITEM VENDING AND GAME APPARATUS

BACKGROUND OF THE INVENTION

1. Field of the Invention

The present invention generally relates to vending and game machines and, more particularly, is concerned with a coin-operated item vending and game apparatus.

2. Description of the Prior Art

Coin-operated vending machines have been popular for many years. Gum ball machines have been a favorite type of coin-operated vending machine. Various gum ball machines have been developed. Some gum ball machines have games associated with them. Other types of coin-operated vending machines also have games associated with them. Still other types of coin-operated machines are just games or coin banks.

Representative examples of coin-operated item vending machines and other coin-operated machines are disclosed in U.S. Pat. No. 553,078 to Smith et al., U.S. Pat. No. 1,138,261 to Troidl, U.S. Pat. No. 2,606,088 to Leaf, U.S. Pat. No. 2,675,238 to Leaf, U.S. Pat. No. 2,959,415 to Peterson, U.S. Pat. No. 4,243,227 to Strongin, U.S. Pat. No. 4,297,807 to Buettner, U.S. Pat. No. 4,487,414 to Karkkainen et al., U.S. Pat. No. 5,417,435 to Peretz and U.S. Pat. No. 5,697,828 to Smathers et al. In particular, the Smith et al., Troidl and Leaf patents disclose vending machines, including gum ball machines, which have games associated with them, and the Peretz patent is just a game machine. While each of these prior art vending and/or game machines may be satisfactory in use for the specific purposes for which they were designed, none of these prior art machines seem to combine a coin-operated item vending machine and a game in an optimally effective way to encourage use of the vending machine.

Consequently, a need remains for an apparatus which provides a solution to the aforementioned problem in the prior art without introducing any new problems in place thereof.

SUMMARY OF THE INVENTION

The present invention provides a coin-operated item vending and game apparatus designed to satisfy the aforementioned need. The vending and game apparatus of the present invention combines an item vending machine, such as a gum ball machine, and a game module in a more effective way to encourage use of the apparatus. The apparatus allows an user to attempt to make a target with a coin. Also, the apparatus allows the user to be able prove when the target is made in case the proprietor of the apparatus has offered a prize when the target is made. The coin thereafter may be used to obtain a vendable item from the machine both when the target is made and when the target is missed.

Accordingly, the present invention is directed to a game module for a coin-operated item vending machine. The game module comprises: (a) a housing positionable substantially within an interior cavity of a globe of a coin-operated item vending machine and between an elongated central support member of the machine and a side of the globe of the machine, the housing including (i) opposite upper and lower end portions, (ii) a front wall disposable adjacent to the side of the globe of the machine and defining a slot, (iii) a back wall disposable adjacent to the support member of the machine and (iv) opposite side walls disposed between and interconnecting the front and back walls and together therewith defining an interior cavity open at and converging to the lower end portion of the housing which is extendable through a hole in a top portion of a support base of the machine such that the lower end portion of the housing is disposable exteriorly of the machine and above a slot of a coin deposit of the machine and the interior cavity of the housing is aligned with the slot of the coin deposit of the machine to allow for passage of a coin through the lower end portion of the housing and into the slot of the coin deposit of the machine; (b) a target disposed within the interior cavity of and mounted to the housing; and (c) a flexible resilient lever having opposite inner and outer ends and defining means thereon for retaining a coin, the lever being disposed below the target and extending through the interior cavity of the housing and mounted at the inner end of the lever to the housing, the lever also extending through the slot of the front wall of the housing and extendable through a slot in the side of the globe of the machine such that the outer end of the lever is disposable exteriorly of the globe of the machine and the coin retaining means of the lever is disposed interiorly of the front wall of the housing, the slot of the front wall of the housing and the slot of the side of the globe of the machine each allowing for manual inserting by an user of the coin therethrough such that the coin can be placed on the coin retaining means of the lever, the outer end of the lever for gripping by one or more fingers of the user and being depressible downwardly by the user causing bending of the lever from an initial condition and creating an upward force because of the resiliency of the lever such that release of the lever by the user allows the lever to spring back to the initial condition and toss the coin upwardly such that the coin will either make or miss the target depending on the skill of the user and the coin upon missing the target will fall onto the housing walls and be guided by the lower end portion thereof into the slot of the coin deposit causing the dispensing of a vendable item to the user upon rotation of a knob of the coin deposit by the user.

More particularly, the housing is made of a substantially transparent material. The lower end portion of the housing has a cross-sectional configuration substantially converging to cross-sectional configurations of the coin and of the slot of the coin deposit of the machine and has a cross-sectional size slightly greater than the cross-sectional size of the coin and substantially the same as the cross-sectional size of the coin deposit slot. The housing has a lid removably mounted to the upper end portion thereof. The target is mounted to the back wall and spaced below the upper end portion of the housing. The target has a substantially tubular configuration and opposite upper and lower ends and defines an interior passage open at the upper and lower ends. The interior passage of the target has a substantially cylindrical configuration and a diameter slightly greater than a diameter of the coin so as to allow for passage of the coin therethrough. One of the side walls of the housing defines a hole and the target defines a slot aligned with the hole of the housing and with a hole in the side of the globe of the machine. The coin retaining means of the lever is a depression defined at an intermediate position on the lever and having a substantially circular configuration conforming to the configuration of the coin for receiving the coin thereon.

The game module further comprises a coin capture and release mechanism including an elongated member having opposite inner and outer ends and extending through the slot of the target and the hole of the one side wall of the housing and extendable through the hole of the side of the globe of the machine such that the outer end of the elongated member is disposable exteriorly of the globe of the machine and such that the coin target plate is disposed interiorly of the one side wall of the housing, the elongated member being movable between an extended position and a retracted position. The mechanism also includes a coin target plate formed on the inner end of the elongated member such that when the elongated member is in the extended position the coin target plate is disposed within the interior passage of the target for receiving the coin thereon which lands within the interior passage of the target so that the user can prove that the target was made whereas when the elongated member is in the retracted position the coin target plate is disposed exteriorly of the target for allowing the coin resting on the coin target plate within the interior passage of the target to drop through the rest of the interior passage of the target and pass through the lower end of the target such that the coin falls onto the housing walls and through the lower end portion of the housing and into the slot of the coin deposit of the machine. The mechanism further includes a spring captured between the coil target plate and the one side wall of the housing such that the elongated member is biased to the extended position and such that by the user gripping the outer end of the elongated member the coin target plate may be pulled from the interior passage of the target to exteriorly of the target.

The present invention is also directed to the above-defined game module in combination with the prior art coin-operated item vending machine.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
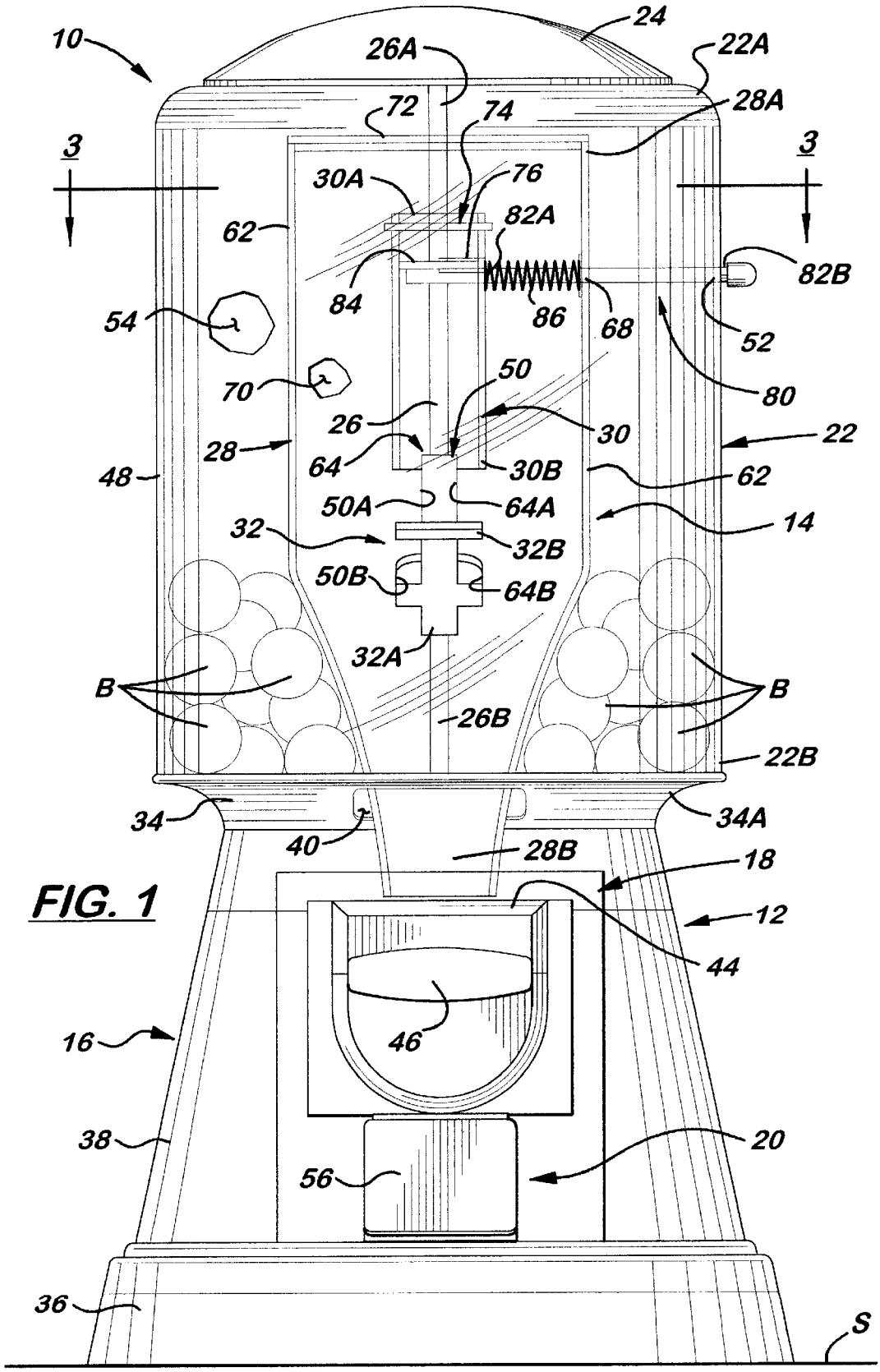
FIG. 1 is a front elevational view of a coin-operated item vending and game apparatus of the present invention.
Figure 2:
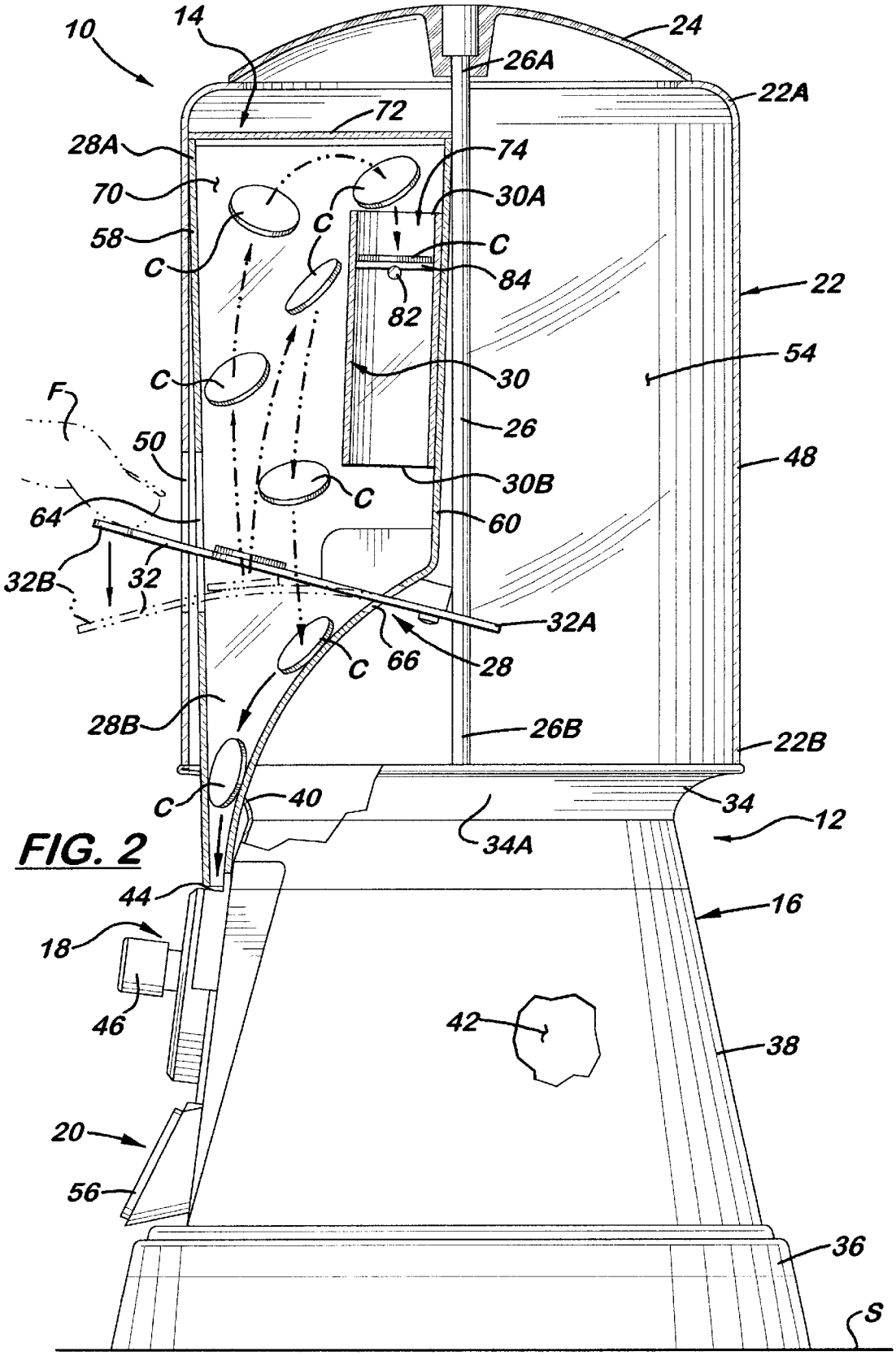
FIG. 2 is a side elevational view of the gum ball game apparatus rotated ninety degrees relative to the apparatus shown in FIG. 1 and showing a finger of an user in contact with a flexible resilient lever of a game module of the apparatus.

Referring to the drawings and particularly to FIGS. 1 and 2, there is illustrated a coin-operated item vending and game apparatus, generally designated 10, of the present invention. The apparatus 10 basically includes an coin-operated item vending machine 12 and a game module 14. The coin-operated item vending machine 12 alone is per se a well-known prior art gum ball machine except for several modifications made thereto, as will be described hereinafter, to accommodate the presence and operation of the game module 14. The vending machine 12 basically includes a support base 16, a coin deposit 18, an item dispenser 20, a globe 22, a lid 24 and an elongated central rod-like support member 26. The game module 14 basically includes a housing 28, a target 30 and a flexible resilient lever 32.

Figure 3:
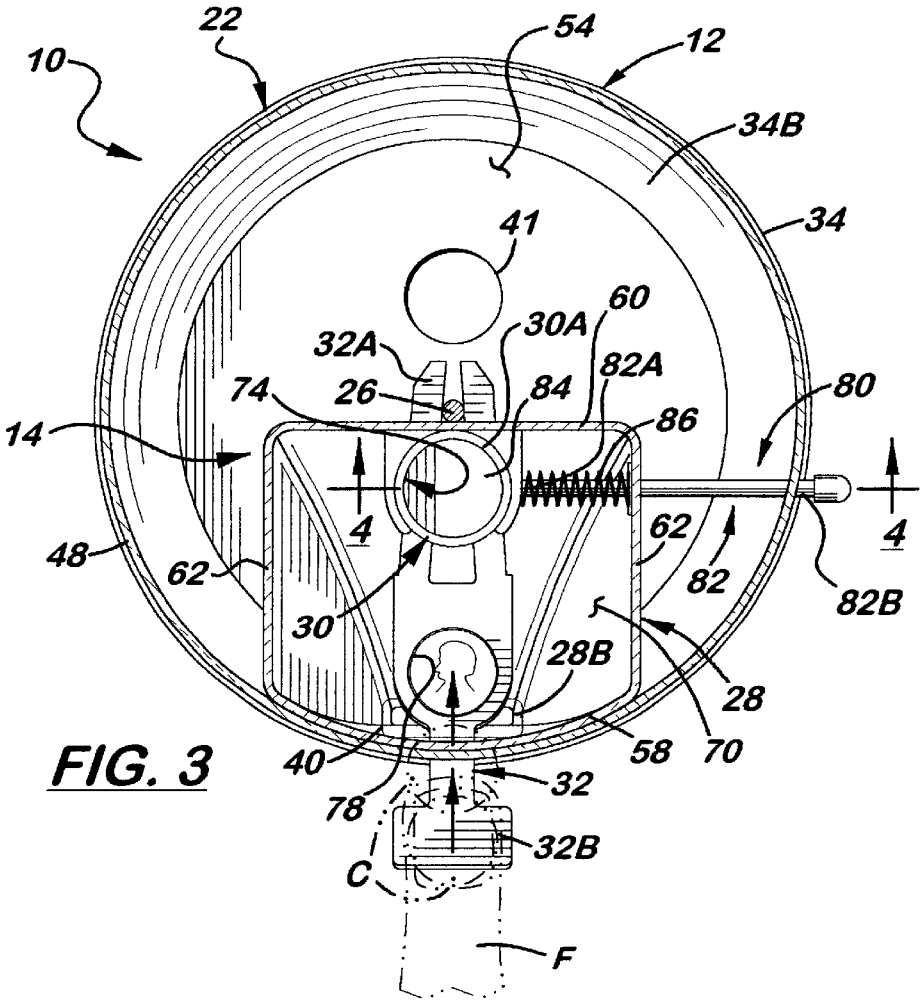
FIG. 3 is a cross-sectional view of the apparatus taken along line 3—3 of FIG. 1.
Figure 4:
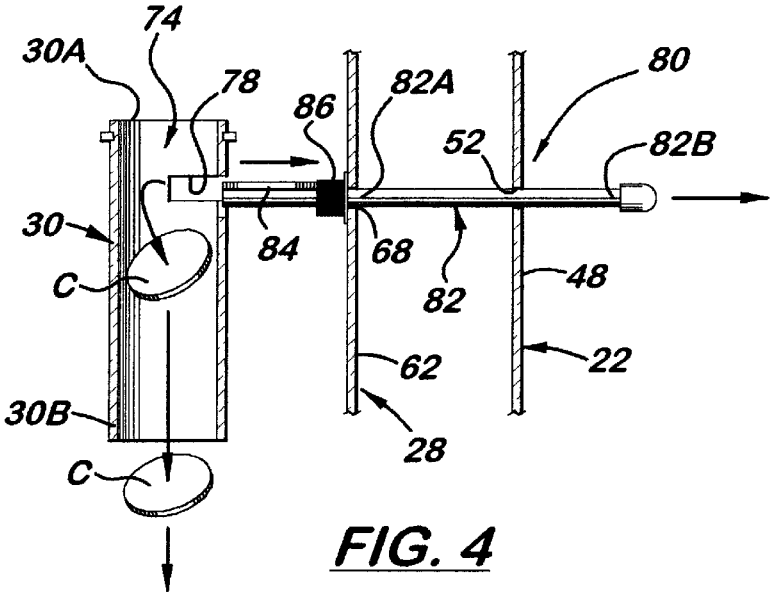
FIG. 4 is a longitudinal view, partly sectioned and partly in elevation, of a target and a coin capture and release mechanism of the game module of the apparatus taken along line 4—4 of FIG. 3.

Referring now to FIGS. 1 to 3, the support base 16 of the vending machine 12 has a top portion 34, a bottom portion 36 and a middle portion 38 disposed between and interconnects the top and bottom portions 34, 36. The top portion 34 has an outer surface 34A and an inner surface 34B. The outer surface 34A has a substantially concave configuration while the inner surface 34B has a substantially bowl-like configuration which is inclined downwardly and inwardly to a center of the top portion 34. The support base 16 has a hole 40 and an opening 41 in the top portion 34. The hole 40, which constitutes one of the modifications to the prior art vending machine 12, extends between and is open at the outer surface 34A and the inner surface 34B and has a substantially rectangular configuration being greater in length than height. The opening 41 is disposed at the center of the top portion 34 and has a substantially circular configuration. The opening 41 has a diameter slightly greater than a diameter of a vendable item, such as a gum ball B, such that only one item at a time may pass through the opening 41. The top portion 34 receives and retains a plurality of the items, the gum balls B, on the inner surface 34B thereof, as seen in FIG. 1. The support base 16 also defines an interior chamber 42 in the middle portion 38. The interior chamber 42 is for receiving and retaining coins C therein. Each of the bottom and middle portions 36, 38 has a substantially cylindrical configuration. The middle portion 38 has a size which is greater than a size of the bottom portion 36 which, in turn, is greater than a size of the top portion 34 for resting on a surface S. The middle portion 38 tapers from the top portion 34 to the bottom portion 36.

The coin deposit 18 of the vending machine 12 is provided on and disposed below the hole 40 of the top portion 34 of the support base 16. The coin deposit 18 defines a slot 44 for receiving a coin C and has a knob 46 rotatable to drop the coin C into the interior chamber 42 of the support base 16. The slot 44 has a cross-sectional configuration which generally conforms to the cross-sectional configurations of the hole 40 of the top portion 34 of the support base 16 and of the coin C. The slot 44 has a size which is less than a size of the hole 40 of the top portion 34 of the support base 16 but which is slightly greater than a cross-sectional size of the coin C such that the coin C may drop therein.

The vendable item dispenser 20 of the vending machine 12 is provided on the support base 16. The dispenser 20 allows for passage of items one at a time from the top portion 34 of the support base 16 to the exterior of the support base 16 in response to rotation of the knob 46 of the coin deposit 18. The dispenser 20 includes a passageway (not shown) of a size allowing only one item at a time to pass therethrough. The dispenser 20 also includes means (not shown) for opening and closing the passageway in response to rotation of the knob 46 of the coin deposit 18.

The globe 22 of the vending machine 12 is comprised of a substantially transparent material and has a substantially cylindrical configuration. The globe 22 has opposite upper and lower ends 22A, 22B and a continuous sidewall 48 that extends between the upper and lower ends 22A, 22B. The globe 22 also has a slot 50, a hole 52 and an interior cavity 54. The slot 50 and hole 52, which constitute the other modifications of the prior art vending machine 12, are defined through respective front and side areas of the sidewall 48 of the globe 22 and spaced apart from one another about ninety degrees around globe 22. The slot 50 is spaced from but disposed closer to the lower end 22B than to the upper end 22A of the globe 22 and is vertically aligned with the hole 40 of the top portion 34 of the support base 16. The slot 50 has a vertical portion 50A and a horizontal portion 50B which crosses the vertical portion 50A. The vertical portion 50A has a height which is greater than a width thereof. The width of the vertical portion 50A is less than a length and is greater than a height of the horizontal portion 50B. The hole 52 has a substantially circular configuration and is spaced from but disposed closer to the upper end 22A than to the lower end 22B of the globe 22. The interior cavity 54 is disposed between the upper and lower ends 22A, 22B and the side 48 of the globe 22. The interior cavity 54 also is open at each of the upper and lower ends 22A, 22B of the globe 22. The opening of the lower end 22B has a size greater than a size of the opening of the upper end 22A of the globe 22. Each of the openings of the upper and lower ends 22A, 22B of the globe 22 has a substantially circular configuration. The globe 22 is mounted at the lower end 22B to the top portion 34 of the support base 16 and thereby is closed at the lower end 22B and surrounds and contains the vendable items on the inner surface 34B of the top portion 34 of the support base 16.

The lid 24 of the vending machine 12 has a substantially rounded configuration and is removably mounted to the upper end 22A of the globe 22 and thereby closes the globe 22 at the upper end 22A thereof. The support member 26 of the vending machine 12 is disposed centrally within the interior cavity 54 of the globe 22 and has opposite upper and lower ends 26A, 26B. The support rod 26 is connected at the upper end 26A to the lid 24 and is mounted at the lower end 26B to the dispenser 20. The lid 24 has means for releasably latching the lid 24 to the upper end 26A of the support rod 26.

The vending machine 12 also includes a door 56. The door 56 has a substantially flat rectangular configuration and is hingedly mounted to the dispenser 20 adjacent to and above the exterior end of the passageway of the dispenser 20 and spaced from but adjacent to the middle portion 38 of the support base 16. The door 56 is movable between a closed position and an open position relative to the exterior end of the passageway of the dispenser 20. The door 56 in the closed position covers the exterior end of the passageway of the dispenser 20 whereas in its open position uncovers the exterior end of the passageway and thereby allows access to items released by the dispenser 20.

The housing 28 of the game module 14 is also made of a substantially transparent material and is positioned within the interior cavity 54 of the globe 22 of the vending machine 12 between the support member 26 and the sidewall 48 of the globe 22 thereof. The housing 28 has a size which is less than half of the size of the interior cavity 54 of the globe 22. The housing 28 has opposite upper and lower end portions 28A, 28B, opposite front and back walls 58, 60 and opposite side walls 62 extending between and interconnecting the front and back walls 58, 50. The front wall 58 is disposed adjacent to a front area of the sidewall 48 of the globe 22 and has a slot 64. The slot 64 in the front wall 58 is aligned with and has a configuration which conforms to the configuration of the slot 50 in the front area of the sidewall 48 of the globe 22. The slot 64 in the front wall 58 has a vertical portion 64A and a horizontal portion 64B which crosses the vertical portion 64A. The vertical portion 64A has a height which is greater than the width thereof. The width of the vertical portion 64A is less than the length and is greater than the height of the horizontal portion 64B. The back wall 60 is disposed adjacent to the support member 26 and has a slot 66. The slot 66 in the back wall 60 is generally aligned with the slot 64 of the front wall 58 and has a generally rectangular configuration. One of the side walls 62 has a hole 68 of a substantially circular configuration which is aligned with the hole 52 in the one side area of the sidewall 48 of the globe 22.

The front, back and side walls 58, 60, 62 of the housing 28 together define therebetween an interior cavity 70. The interior cavity 70 of the housing is open at each of the upper and lower end portions 28A, 28B. The front, back and side walls 58, 60 and 62 of the housing 28 also converge at the lower end portion 28B of the housing 28 and extend downward through the hole 40 of the top portion 34 of the support base 16 of the vending machine 12 such that the lower end portion 28B of the housing 28 is disposed above the slot 44 of the coin deposit 18 of the vending machine 12 with the interior cavity 70 of the housing 28 in communication with the slot 44 of the coin deposit 18 so as to allow for passage of the coin C through the lower end portion 28B of the housing 28. The housing 28 above where the front, back and side walls 58, 60 and 62 begin to converge has a substantially rectangular cross-sectional configuration. The housing 28 below where the front, back and side walls 58, 60 and 62 begin to converge has a substantially funnel-like configuration. The lower end portion 28B of the housing 28 has a cross-sectional configuration which substantially conforms to the cross-sectional configurations of the coin C and of the slot 44 of the coin deposit 18 and has a cross-sectional size which is slightly greater than the cross-sectional size of the coin C and which is substantially the same as the size of the slot 44 of the coin deposit 18. The lower funnel-like configuration of the housing 28 guides the coin C through the lower end portion 28B of the housing 28 and such that the coin C is delivered in the appropriate orientation to the slot 44 of the coin deposit 18.

The housing 28 also has a lid 72 of a substantially flat rectangular configuration. The lid 72 is removably mounted to the upper end portion 28A of the housing 28 to thereby close the housing 28 at the upper end portion 28A. The lid 72 is normally closed but may be opened for any reason.

The target 30 of the game module 14 is disposed within the interior cavity 70 of and is mounted to the housing 28. The target 30 is, particularly, mounted to the back wall 60 and spaced below the upper end 28A of the housing 28. The space between the upper end 28A of the housing 28 and the target 30 is to allow for passage of a coin C therebetween such that the coin C may make the target 30. The target 30 is spaced closer to the upper end portion 28A than to the lower end portion 28B of the housing 28. The target 30 has a substantially tubular, and more particularly a cylindrical, configuration. The target 30 is similar to a basket used in a game of basketball. Pictures and the like may be mounted to the back wall 60 of the housing 28 behind and around the target 30. The pictures may be of basketball players to enhance usage of the apparatus 10. The target 30 has opposite upper and lower ends 30A, 30B and defines an interior passage 74 which is open at the upper and lower ends 30A, 30B. The interior passage 74 has a generally cylindrical configuration and a diameter which is slightly greater than the diameter of the coin C so as to allow for passage of the coin C therethrough. The target 30 also has a slot 76 aligned with the hole 68 in the one side wall 62 of the housing 28 and with the hole 52 in the side area of the sidewall 48 of the globe 22 of the vending machine 12. The target 30 has a length which is less than a length of the housing 28 above where the front, back and side walls 58, 60 and 62 begin to converge.

The lever 32 of the game module 14 is elongated and has a substantially flat rectangular configuration. The lever 32 has opposite inner and outer ends 32A, 32B and defines means thereon for retaining a coin C. The lever 32 extends through the interior cavity 70 and the slot 66 in the back wall 60 of the housing 28 and is mounted at the inner end 32A to the back wall 60 of the housing 28 and has a bifurcation at the inner end 32A with interfits with the support member 26 of the vending machine 12. The lever 32 has a width which is less than the width of each of the vertical portions 50A, 64A of the slots 50, 64 of the sidewall 48 of the globe 22 of the vending machine 12 and of the front wall 58 of the housing 28. The lever 32 extends through the slot 64 of the front wall 58 of the housing 28 and through the slot 50 of the sidewall 48 of the globe 22 such that the outer end 32B of the lever 32 is disposed exteriorly of the globe 22 and the coin retaining means of the lever 32 is disposed interiorly of the front wall 58 of the housing 28. The horizontal portion 64B of the slot 64 of the front wall 58 of the housing 28 and the horizontal portion 50B of the slot 50 of the sidewall 48 of the globe 22 each has a size greater than the cross-sectional size of the coin C so as to allow for manual inserting by an user of the coin C therethrough such that the coin C can be placed on the coin retaining means of the lever 32. The coin retaining means of the lever 32 is a depression 78 defined thereon at an intermediate position on the lever 32 and of a generally circular configuration. The depression 78 has a diameter which is slightly greater than the diameter of the coin C for receiving the coin C thereon.

The outer end 32B of the lever 32 is for gripping by one or more fingers F of a hand of the user and is depressible downwardly by the user bending the lever 32 from an initial relaxed condition shown in solid line form in FIG. 2 to the depressed dashed line condition shown in FIG. 2. Such bending of the lever 32 creates an upward force because of the resiliency of the lever 32 such that the subsequent release of the lever 32 by the user allows the lever 32 to spring back to its initial relaxed condition and toss the coin C upwardly such that the coin C will either make or miss the target 30 depending on the skill of the user. The coin C upon missing the target 30 will fall onto the housing walls 58, 60, 62 and be guided by the lower end portion 32B thereof into the slot 44 of the coin deposit 18 of the vending machine 12 causing the dispensing of the vendable item B to the user at the door 56 of the dispenser 20 upon rotation of the knob 46 of the coin deposit 18 by the user. The coin C may generally follow one of two paths after having been tossed upon release of the lever 32. One path involves making the target 30, such as by passing through the open upper end 30A of the target 30 into the interior passage 74 of the target 30. The other path involves missing the target 30 and falling down onto the housing 28.

Referring now to FIGS. 1 to 4, the game module 14 also includes a coin capture and release mechanism 80 associated with the target 30. The coin capture and release mechanism 80 includes an elongated member 82 having a substantially rod-like configuration for most of its length and opposite inner and outer ends 80A, 80B. The mechanism 80 also includes a coin target plate 84 and a spring 86. The coin target plate 84 is attached on the inner end 82A of the elongated member 82 and has a substantially flat circular configuration which substantially conforms to that of the coin C. The coin target plate 84 has a diameter which is slightly less than the diameter of the interior passage 74 of the target 30 and the same as the diameter of the coin C. The slot 76 of the target 30 has a configuration which substantially conforms to the cross-sectional configuration of the coin target plate 84 and has a size which is slightly greater than the cross-sectional size of the coin target plate 84 such that the coin target plate 84 may pass therethrough. The elongated member 82 extends through the slot 76 of the target 30 and through the hole 68 of the one side wall 62 of the housing 28 and through the hole 52 of the sidewall 48 of the globe 22 such that the outer end 82B of the elongated member 82 is disposed exteriorly of the globe 22 and the coin target plate 84 is disposed interiorly of the one side wall 62 of the housing 28.

The elongated member 82 of the mechanism 80 is movable between an extended position and a retracted position. When the elongated member 82 is at the extended position shown in FIGS. 1 to 3, the coin target plate 84 is disposed within the interior passage 74 of the target 30 for receiving the coin C thereon which is following the path through the interior passage 74 of the target 30. By the coin landing on the coin target plate 84, the user can prove to the proprietor of the apparatus 10 that the target 30 was made in case a prize is offered to users who make the target. When the elongated member 82 is at the retracted position shown in FIG. 4, the coin target plate 84 is disposed exteriorly of the target 30 allowing the coin C resting on the coin target plate 84 within the interior passage 74 of the target 30 to drop through the rest of the interior passage 74 of the target 30 and pass through the lower end portion 30B of the target 30 such that the coin C passes into the slot 44 of the coin deposit 18 of the vending machine 12 causing the dispensing of the vendable item B to the user upon rotation of the knob 46 of the coin deposit 18 by the user. Thus, the user will obtain a vendable item, i.e. a gum ball B, whether a target 30 is made or missed.

The spring 86 of the mechanism 80 is a coil type of spring captured between the coin target plate 84 and the one side wall 62 of the housing 28 such that the elongated member 82 are biased toward its extended position. The user grips the outer end 82B of the elongated member 82 and pulls it to the retracted position to move the coin target plate 84 from the interior passage 74 of the target 30 to exteriorly of the target 30. Upon release of the elongated member 82, the spring 86 automatically returns the elongated member 82 to its extended position and the coin target plate 84 back across the passage 74 of the target 30.

To recapitulate, the coin-operated item vending and game apparatus 10 includes the coin-operated item vending machine 12 and game module 14. The vending machine 12 includes the support base 16, coin deposit 18, vendable items dispenser 20, globe 22 and elongated central support member 26. The game module 14 includes the housing 28, target 30 and flexible resilient lever 32. The housing 28 is disposed within the globe 22 and has interconnected walls 58, 60, 62 converging to the lower end portion 28B of the housing 28 which extends through the hole 40 in support base 16 to above the exterior slot 44 of the coin deposit 18. The target 30 is disposed within the housing 28. The lever 32 is disposed below the target 30 and extends through adjacent slots 64, 50 in the housing 28 and globe 22 and is mounted at the inner end 32A to the housing 28 such that the outer end 32B of the lever 32 is disposed exteriorly of the globe 22. The depression 78 defined on the lever 32 between its inner and outer ends 32A, 32B for receiving and retaining the coin C is disposed interiorly of the housing 28. The slots 64, 50 in the housing 28 and globe 22 allow an user to manually insert the coin C into the globe 22 and housing 28 above and along the lever 32 onto the depression 78 thereon. With the coin C disposed on the lever 32, the outer end 32B of the lever 32 is manually depressed downwardly by the user causing bending of the lever 32 from an initial condition and creating an upward force because of the resiliency of the lever 32. Release of the lever 32 by the user allows the lever 32 to spring back to its initial condition and toss the coin C upwardly such that the coin C will either make or miss the target 30 depending on the skill of the user. Regardless of whether the coin C makes the target 30 and is then released or misses the target 30, the coin C will fall onto the housing walls 58, 60, 62 and be guided by the lower end portion 28B thereof into coin deposit slot 44 causing the dispensing of a vendable item B to the user upon rotation of a knob 46 of the coin deposit 18 by the user.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A game module for a coin-operated item vending machine, said game module comprising:

(a) a housing positionable substantially within an interior cavity of a globe of a coin-operated item vending machine and between an elongated central support member of the machine and a side of the globe of the machine, the housing including (i) opposite upper and lower end portions, (ii) a front wall disposable adjacent to the side of the globe of the machine, (iii) a back wall disposable adjacent to the support member of the machine and defining a slot, and (iv) opposite side walls disposed between and interconnecting said front and back walls and together therewith defining an interior cavity open at and converging to said lower end portion of said housing which is extendable through a hole in a top portion of a support base of the machine such that said lower end portion of said housing is disposable exteriorly of the machine and above a slot of a coin deposit of the machine and said interior cavity of said housing is aligned with the slot of the coin deposit of the machine to allow for passage of a coin through said lower end portion of said housing and into the slot of the coin deposit of the machine;

(b) a target disposed within said interior cavity of and mounted to said housing; and (c) a flexible resilient lever having opposite inner and outer ends and defining means thereon for retaining a coin, said lever being disposed below said target and extending through said interior cavity of said housing and mounted at said inner end of said lever to said housing, said lever also extending through said slot of said front wall of said housing and extendable through a slot in the side of the globe of the machine such that said outer end of said lever is disposable exteriorly of the globe of the machine and said coin retaining means of said lever is disposed interiorly of said front wall of said housing, said slot of said front wall of said housing and the slot of the side of the globe of the machine each allowing for manual inserting by an user of the coin therethrough such that the coin can be placed on said coin retaining means of said lever, said outer end of said lever for gripping by one or more fingers of the user and being depressible downwardly by the user causing bending of said lever from an initial condition and creating an upward force because of the resiliency of said lever such that release of said lever by the user allows said lever to spring back to said initial condition and toss the coin upwardly such that the coin will either make or miss said target depending on the skill of the user and the coin upon missing said target will fall onto said housing walls and be guided by said lower end portion thereof into the slot of the coin deposit causing the dispensing of a vendable item to the user upon rotation of a knob of the coin deposit by the user.

2. The game module of claim 1 wherein said housing is made of a substantially transparent material.

3. The game module of claim 1 wherein said lower end portion of said housing has a cross-sectional configuration substantially converging to cross-sectional configurations of the coin and of the slot of the coin deposit of the machine and has a cross-sectional size slightly greater than a cross-sectional size of the coin and substantially the same as a size of the slot of the coin deposit of the machine.

4. The game module of claim 1 wherein said housing has a lid removably mounted to said upper end portion of said housing.

5. The game module of claim 1 wherein said target is mounted to said back wall and spaced below said upper end portion of said housing.

6. The game module of claim 1 wherein said target has a substantially tubular configuration.

7. The game module of claim 1 wherein said target has opposite upper and lower ends and defines an interior passage open at said upper and lower ends of said target, said interior passage of said target having a substantially cylindrical configuration and a diameter slightly greater than a diameter of the coin so as to allow for passage of the coin therethrough.

8. The game module of claim 7 wherein:

one of said side walls of said housing defines a hole;

said target defines a slot aligned with said hole of the one said side wall of said housing and with a hole in the side of the globe of the machine; and said game module further comprises a coin capture and release mechanism including (i) an elongated member having opposite inner and outer ends and extending through said slot of said target and said hole of said one side wall of said housing and extendable through said hole of the side of the globe of the machine such that said outer end of said elongated member is disposable exteriorly of the globe of the machine and said coin target plate is disposed interiorly of said one side wall of said housing, said elongated member being movable between an extended position and a retracted position, (ii) a coin target plate formed on said inner end of said elongated member such that when said elongated member is in the extended position said coin target plate is disposed within said interior passage of said target for receiving the coin thereon which lands within said interior passage of said target so that the user can prove that said target was made whereas when said elongated member is in the retracted position said coin target plate is disposed exteriorly of said target for allowing the coin resting on said coin target plate within said interior passage of said target to drop through the rest of said interior passage of said target and pass through said lower end of said target such that the coin falls onto said housing walls and through said lower end portion of said housing and into the slot of the coin deposit of the machine, and (iii) a spring captured between said coil target plate and said one side wall of said housing such that said elongated member is biased to the extended position and by the user gripping said outer end of said elongated member said coin target plate may be pulled from said interior passage of said target to exteriorly of said target.

9. The game module of claim 8 wherein said coin target plate has a substantially flat circular configuration substantially conforming to a configuration of the coin and has a diameter slightly less than said diameter of said interior passage of said target and substantially the same as the diameter of the coin.

10. The game module of claim 1 wherein said coin retaining means of said lever is a depression defined at an intermediate position on said lever and having a substantially circular configuration substantially conforming to a configuration of the coin and having a diameter slightly greater than a diameter of the coin for receiving the coin thereon.

11. A coin-operated item vending and game apparatus, comprising:

(a) a coin-operated item vending machine including (i) a support base for receiving and retaining coins therein and having a top portion for receiving and retaining vendable items thereon and having a hole defined in said top portion, (ii) a coin deposit on said support base and disposed below said hole of said top portion of said support base and defining a slot for receiving a coin and having a knob rotatable to drop the coin into said support base, (iii) an vendable item dispenser on said support base and allowing for passage of vendable items one at a time from said top portion of said support base to an exterior of said support base in response to rotation of said knob of said coin deposit, (iv) a globe having opposite upper and lower ends and a side and defining a slot and an interior cavity, said slot of said globe being defined through said side of said globe, said interior cavity of said globe being open at least at said lower end of said globe, said globe being mounted at said lower end thereof on said support base and thereby being closed at said lower end of said globe and surrounding and containing vendable items on said top portion of said support base, and (v) an elongated central support member having opposite upper and lower ends and mounted at said lower end to said vendable item dispenser; and (b) a game module for said coin-operated item vending machine, said game module including (i) a housing positioned substantially within said interior cavity of said globe of said coin-operated item vending machine and between said elongated central support member of said vending machine and said side of said globe of said vending machine, said housing including opposite upper and lower end portions, a front wall disposable adjacent to said side of said globe of said vending machine and defining a slot, a back wall disposable adjacent to said support member of said vending machine, and opposite side walls disposed between and interconnecting said front and back walls and together therewith defining an interior cavity open at and converging to said lower end portion of said housing which extends through said hole in said top portion of said support base of said machine such that said lower end portion of said housing is disposable exteriorly of said vending machine and above said slot of said coin deposit of said vending machine and said interior cavity of said housing is aligned with said slot of said coin deposit of said vending machine to allow for passage of a coin through said lower end portion of said housing and into said slot of said coin deposit of said vending machine, (ii) a target disposed within said interior cavity of and mounted to said housing, and (iii) a flexible resilient lever having opposite inner and outer ends and defining means thereon for retaining a coin, said lever being disposed below said target and extending through said interior cavity of said housing and mounted at said inner end of said lever to said housing, said lever also extending through said slot of said front wall of said housing and through said slot in said side of said globe of said vending machine such that said outer end of said lever is disposed exteriorly of said globe of said vending machine and said coin retaining means of said lever is disposed interiorly of said front wall of said housing, said slot of said front wall of said housing and said slot of said side of said globe of said vending machine each allowing for manual inserting by an user of the coin therethrough such that the coin can be placed on said coin retaining means of said lever, said outer end of said lever for gripping by one or more fingers of the user and being depressible downwardly by the user causing bending of said lever from an initial condition and creating an upward force because of the resiliency of said lever such that release of said lever by the user allows said lever to spring back to said initial condition and toss the coin upwardly such that the coin will either make or miss said target depending on the skill of the user and the coin upon missing said target will fall onto said housing walls and be guided by said lower end portion thereof into said slot of said coin deposit causing the dispensing of a vendable item to the user upon rotation of a knob of said coin deposit by the user.

12. The apparatus of claim 11 wherein each of said globe of said vending machine and said housing of said game module is made of a substantially transparent material.

13. The apparatus of claim 11 wherein said lower end portion of said housing of said game module has a cross-sectional configuration substantially converging to cross-sectional configurations of the coin and of said slot of said coin deposit of said vending machine and has a cross-sectional size slightly greater than a cross-sectional size of the coin and substantially the same as a size of said slot of said coin deposit of said vending machine.

14. The apparatus of claim 11 wherein said housing of said game module has a lid removably mounted to said upper end portion of said housing.

15. The apparatus of claim 11 wherein said target of said game module is mounted to said back wall and spaced below said upper end portion of said housing of said game module.

16. The apparatus of claim 11 wherein said target of said game module has a substantially tubular configuration.

17. The apparatus of claim 11 wherein said target of said game module has opposite upper and lower ends and defines an interior passage open at said upper and lower ends of said target, said interior passage of said target having a substantially cylindrical configuration and a diameter slightly greater than a diameter of the coin so as to allow for passage of the coin therethrough.

18. The apparatus of claim 17 wherein:

said globe of said vending machine defines a hole through said side of said globe;

one of said side walls of said housing of said game module defines a hole;

said target of said game module defines a slot aligned with said hole of the one said side wall of said housing of said game module and with said hole of said side of said globe of said vending machine; and said game module further comprises a coin capture and release mechanism including (i) an elongated member having opposite inner and outer ends and extending through said slot of said target and said hole of said one side wall of said housing and extending through said hole of said side of said globe of said vending machine such that said outer end of said elongated member is disposed exteriorly of said globe of said vending machine and said coin target plate is disposed interiorly of said one side wall of said housing, said elongated member being movable between an extended position and a retracted position, (ii) a coin target plate formed on said inner end of said elongated member such that when said elongated member is in the extended position said coin target plate is disposed within said interior passage of said target for receiving the coin thereon which lands within said interior passage of said target so that the user can prove that said target was made whereas when said elongated member is in the retracted position said coin target plate is disposed exteriorly of said target for allowing the coin resting on said coin target plate within said interior passage of said target to drop through the rest of said interior passage of said target and pass through said lower end of said target such that the coin falls onto said housing walls and through said lower end portion of said housing and into said slot of said coin deposit of said vending machine, and (iii) a spring captured between said coil target plate and said one side wall of said housing such that said elongated member is biased to the extended position and by the user gripping said outer end of said elongated member said coin target plate may be pulled from said interior passage of said target to exteriorly of said target.

19. The apparatus of claim 18 wherein said coin target plate has a substantially flat circular configuration conforming to a configuration of the coin and has a diameter slightly less than said diameter of said interior passage of said target of said game module and substantially the same as the diameter of the coin.

20. The apparatus of claim 11 wherein said coin retaining means of said lever of said game module is a depression defined at an intermediate position on said lever and having a substantially circular configuration conforming to a configuration of the coin and having a diameter slightly greater than a diameter of the coin for receiving the coin thereon.

* * * * *